US007284744B1

(12) United States Patent
Lerchenmueller et al.

(10) Patent No.: US 7,284,744 B1
(45) Date of Patent: Oct. 23, 2007

(54) LIFTING DEVICE

(75) Inventors: Peter Lerchenmueller, Hard (AT); Josef Fitz, Lustenau (AT)

(73) Assignee: Hans Kuenz Gesellschaft m.b.H., Hard (AT)

( * ) Notice: Subject to any disclaimer, the term of this patent is extended or adjusted under 35 U.S.C. 154(b) by 0 days.

(21) Appl. No.: 11/560,085

(22) Filed: Nov. 15, 2006

(30) Foreign Application Priority Data

Jan. 12, 2006 (DE) ..... 20 2006 000 490 U

(51) Int. Cl.
*B66D 1/26* (2006.01)

(52) U.S. Cl. ..... 254/278; 254/290

(58) Field of Classification Search ..... 254/278, 254/290, 316, 340, 342, 371, 372; 212/274, 212/71, 330, 331

See application file for complete search history.

(56) References Cited

U.S. PATENT DOCUMENTS

| | | | | |
|---|---|---|---|---|
| 4,949,855 | A * | 8/1990 | Foit | 212/274 |
| 5,074,528 | A * | 12/1991 | Long, Jr. | 254/285 |
| 5,603,420 | A * | 2/1997 | Swanson | 212/274 |
| 5,765,703 | A * | 6/1998 | Shiwaku | 212/274 |
| 6,053,478 | A * | 4/2000 | Friedman | 254/332 |
| 6,102,372 | A * | 8/2000 | Gersemsky et al. | 254/278 |
| 6,991,064 | B2 * | 1/2006 | Ehrenleitner | 182/141 |

FOREIGN PATENT DOCUMENTS

| | | | |
|---|---|---|---|
| CN | 1548357 | | 11/2004 |
| DE | 2 214 348 | | 10/1973 |
| DE | 40 05 194 | | 8/1990 |
| EP | 1 640 309 | | 3/2006 |
| GB | 2027405 A | * | 2/1980 |
| JP | 11-157774 | | 6/1999 |

OTHER PUBLICATIONS

Düsterer et al., Appl. Phys. B76 (2003) 17-21.

* cited by examiner

*Primary Examiner*—Emmanuel M Marcelo
(74) *Attorney, Agent, or Firm*—Reed Smith LLP

(57) ABSTRACT

A lifting device comprises four pairs of hoisting cables arranged in a V-shape relative to one another for lifting and lowering a load suspension apparatus at which they engage and which are taken off from drivable cable drums. The free lengths of the hoisting cables of two longitudinal pairs of cables lie in longitudinal planes which are located at a distance from one another, and the free lengths of the hoisting cables of two transverse pairs of cables lie in transverse planes which are located at a distance from one another and which extend at right angles to the longitudinal planes. Two mechanically separate hoists are provided for the hoisting cables of the two longitudinal cable pairs and for the hoisting cables of the two transverse cable pairs, each of the hoists is drivable by its own driving motor, and the driving motors are controlled by a common control device.

12 Claims, 4 Drawing Sheets

LIFTING DEVICE

CROSS-REFERENCE TO RELATED APPLICATION

This application claims priority of German Application No. 10 2006 000 490.4, filed Jan. 12, 2006, the complete disclosure of which is hereby incorporated by reference.

BACKGROUND OF THE INVENTION a) Field of the Invention

The invention is directed to a lifting device with four pairs of hoisting cables arranged in a V-shape relative to one another for lifting and lowering a load suspension apparatus at which they engage and which are taken off from drivable cable drums, the free lengths of the hoisting cables of two longitudinal pairs of cables lie in longitudinal planes which are located at a distance from one another, and the free lengths of the hoisting cables of two transverse pairs of cables lie in transverse planes which are located at a distance from one another and which extend at right angles to the longitudinal planes.

b) Description of the Related Art

A known lifting device of the type mentioned above is used in container cranes, whose purpose is to stack containers in several layers, to load and unload trucks, and so on. The cranes are controlled entirely in a fully automatic or semi-automatic manner. The container or the load suspension apparatus carrying the container must be positioned accurately within a range of centimeters. This calls for a load suspension which is as stable as possible and which ensures that no uncontrollable pendulum movements can occur due to the influence of external forces. A design that has proven itself in this respect comprises a cable shaft or cable tower having four pairs of cables, each pair being formed by cables arranged in a V-shape relative to one another. The free lengths of two longitudinal cable pairs lie in longitudinal planes located at a distance from one another, and the free lengths of two transverse cable pairs lie in transverse planes which are located at a distance from one another and extend at right angles to the longitudinal planes.

In the previously known lifting devices of the type mentioned above, two cable drums are disposed at right angles to one another, one cable drum being used to wind up and wind off the longitudinal cable pairs and the other to wind up and wind off the transverse cable pairs. One of the two cables of a cable pair runs from the cable drum directly to the load, and the other runs from the cable drum to the load over a deflection pulley to form the V-shaped arrangement of the two cables. The two cable drums are driven synchronously by a common driving motor via an associated transmission to raise and lower the load suspension apparatus in a desired manner.

In another previously known lifting device with a cable shaft or cable tower of the type described above, all of the cables of the cable pairs are wound on a central cable drum and run over or around corresponding cable rollers (deflection pulleys) to form the V-shaped cable pairs. The central cable drum is driven by a driving motor via a transmission for lifting and lowering the load suspension apparatus.

These previously known lifting devices are disadvantageous in that the adjustments of the lengths of the individual cables are very time-consuming. On the one hand, the adjustments for the cable lengths determine the geometry of the suspension of the load suspension apparatus, and this load suspension apparatus must be suspended centrically as far as possible. Further, the cable lengths must match each other as exactly as possible so that the cables are loaded as uniformly as possible, because different cable tensions shorten the lifetime of the cables. Changes in cable tensions come about over the course of operation so that the cable adjustments must be repeated occasionally. Also, the ratios of the cable tensions can change depending on the operating state so that an optimal adjustment for all operating states may no longer be possible at all.

The size of the different hoisting cable loads is determined particularly by the following influences: positional tolerances of the cable drums and cable pulleys; deformations of the carrying frame for the hoist and parts thereof and deformations of the load suspension apparatus; diameter tolerances and concentricity tolerances of the cable drums, diameter tolerances and concentricity tolerances of the cable pulleys around which the hoisting cables run; diameter tolerances of the cables; differences in the stretching behavior of the cables; different cable lengths and the consequent different elongation behavior; the accuracy of the cable adjustments.

Since uniform cable tensions are crucial in determining the lifetime of the hoisting cables, the greatest possible precision is required for the manufacture and placement of the structural component parts. The cables must come from the same batch so that the diameter and stretching behavior are as identical as possible. Maintenance costs are high, and the lifting device is not available during the time-consuming maintenance work. The expected lifetime of the cables is still relatively low even when these criteria are met.

OBJECT AND SUMMARY OF THE INVENTION

It is the primary object of the invention to provide an improved lifting device of the type mentioned in the beginning in which the maintenance work is reduced and the hoisting cables have a longer expected lifetime.

This object is met, according to the invention, by a lifting device comprising two longitudinal cable pairs with hoisting cables which are arranged in a V-shape relative to one another and which engage at the load suspension apparatus and which are taken off from drivable cable drums for lifting and lowering the load suspension apparatus and which have free lengths of cable lying in longitudinal planes which are located at a distance from one another, and two transverse cable pairs with hoisting cables which are arranged in a V-shape relative to one another and which engage at a load suspension apparatus and which are taken off from drivable cable drums for lifting and lowering the load suspension apparatus and which have free lengths of cable lying in transverse planes which are located at a distance from one another and extend at right angles to the longitudinal planes, wherein two mechanically separate hoists are provided for the hoisting cables of the two longitudinal cable pairs and for the hoisting cables of the two transverse cable pairs, each of the hoists being drivable by its own driving motor, and wherein the driving motors are controlled by a common control device.

Accordingly, in the lifting device of the invention a hoist is provided for the two longitudinal cable pairs on one hand and a hoist which is mechanically separate from the latter, i.e., which is not mechanically coupled with the hoist for the two longitudinal cable pairs, is provided for the two transverse cable pairs. Each of the two hoists has its own driving motor, and the two driving motors are controlled by a common control device. By suitably controlling the two driving motors, substantially identical cable tensions can be achieved for all hoisting cables without requiring an exact adjustment of the hoisting cable itself for this purpose. In this way, the expected lifetime of the hoisting cables can be substantially increased and maintenance work can be substantially reduced.

In an advantageous embodiment form of the invention, each of the two hoists has separate cable drums for the two cables of the cable pairs associated with the respective hoist. The separate cable drums of a respective hoist are mechanically coupled and run synchronous with one another. This does away with the need for deflection pulleys for four of the hoisting cables which would increase wear on the hoisting cables running over them.

The speed of the driving motors of the two hoists is preferably regulated by means of the control device, and a torque regulation is superimposed on this speed regulation as will be described more exactly in the description of the drawings.

Other advantages and details of the invention are described in the following with reference to the accompanying drawings, from which further objects of the invention will be apparent.

DESCRIPTION OF THE PREFERRED EMBODIMENTS

Figure 1:
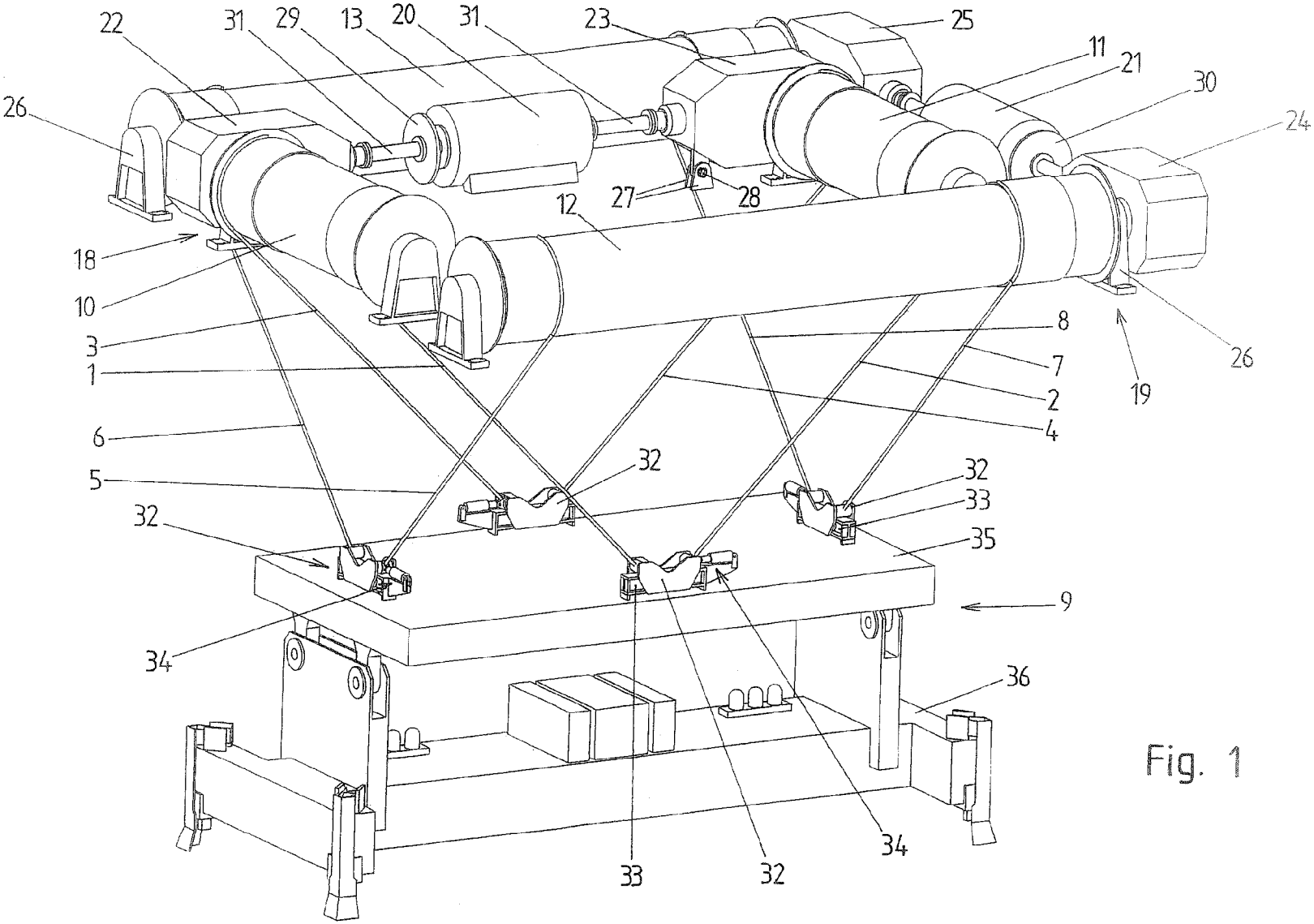
FIGS. 1 and 2 are schematic oblique views of an embodiment example of the invention from different viewing directions.

An embodiment example of a lifting device according to the invention is shown schematically in the drawings. A lifting device of this kind can be used particularly in a crane, e.g., a container crane.

The lifting device comprises eight hoisting cables 1 to 8 which are arranged in pairs in a V-shaped manner relative to one another. Hoisting cables 1 to 8 of a respective pair of cables run apart in an upward direction. At their bottom ends, the hoisting cables 1 to 8 are connected to a load suspension apparatus 9. To lift and lower the load suspension apparatus 9, the hoisting cables 1 to 8, whose top ends are connected to cable drums 10 to 13, can be wound on to and wound off from these cable drums 10 to 13 to varying lengths.

The free lengths of the hoisting cables 1, 2 and 3, 4, respectively, of the two longitudinal cable pairs lie in longitudinal planes 14, 15 which are at a distance from one another. The free lengths of the hoisting cables 5, 6 and 7, 8, respectively, of the two transverse cable pairs lie in transverse planes 16, 17 which are at a distance from one another and which extend at right angles to the longitudinal planes 14, 15. By free length of a cable is meant the portion of the cable that is not wound on the associated cable drum.

The longitudinal planes 14, 15 and transverse planes 16, 17 are oriented substantially vertically. In this connection, substantially vertically means that there may be a certain deviation from the exact vertical orientation and a certain diagonal position of the longitudinal and transverse planes 14 to 17, e.g., because of the varying degree to which the hoisting cables 1 to 8 are wound onto the cable drums 10 to 13 depending on the instantaneous height of the load suspension apparatus 9. This deviation from the vertical is preferably less than 4° in every case.

According to the invention, the lifting device comprises two separate hoists 18, 19. Hoist 18 cooperates with the hoisting cables 1 to 4 of the two longitudinal cable pairs and hoist 19 cooperates with the hoisting cables 5 to 8 of the two transverse cable pairs. Each of the two hoists 18, 19 is driven by its own driving motor 20, 21. Accordingly, the two hoists 18, 19 can be actuated basically independently from one another by means of the driving motors 20, 21 (the two hoists are coupled by means of the electronic control of the two hoists as is described hereinafter). They are not mechanically coupled and accordingly do not compulsorily run synchronously.

The hoist 18 has the two separate cable drums 10, 11. One of the two hoisting cables 1, 3 or 2, 4 of a respective longitudinal cable pair runs off from each of these cable drums 10, 11. The two cable drums 10, 11 of the first hoist 18 are mechanically coupled in such a way that they each have the same speed, that is, they run synchronously. In the embodiment example, this mechanical coupling is carried out by the common driving motor 20. The cable drums 10, 11 are driven by the driving motor 20 in each instance via a transmission 22, 23 which is constructed in the form of an angular gear unit in the present embodiment example.

The hoist 19 comprises the two cable drums 12, 13, one of the two hoisting cables 5, 6; 7, 8 of a respective transverse cable pair running off from these two cable drums 12, 13. The cable drums 12, 13 are mechanically coupled, preferably via the common driving motor 21, so that they have the same speed; that is, they run synchronously. The cable drums 12, 13 are driven by the driving motor 21 via transmissions 24, 25 which are constructed in the form of angular gear units in the present embodiment example.

The two hoists 18, 19 are constructed in an entirely analogous manner in the present embodiment form and can be considered as rotated relative to one another by 90° around a vertical axis.

The longitudinal axes of the cable drums 10, 11 of the hoist 18 for the hoisting cables 1 to 4 of the longitudinal cable pairs extend at right angles to the longitudinal planes 14, 15 in which the hoisting cables 1, 2; 3, 4 of the longitudinal cable pairs lie, and the longitudinal axes of the cable drums 12, 13 of the hoist 19 for the hoisting cables 5 to 8 of the transverse cable pairs extend at right angles to the transverse planes 16, 17 in which the hoisting cables 5, 6; 7, 8 of the transverse cable pairs lie.

The cable drums 10 to 13 are connected to a frame, not shown in the drawings for the sake of simplicity, via bearings 24 which are shown in the drawings as pedestal bearings, and the cable drums 10 to 13 are carried by this frame. When the lifting device is used in a crane, this frame can be the hoist trolley frame of the crane, for example.

The housing of the transmissions 20 to 25 are connected to this frame, for example, by connection plates 27. For example, a plate which is arranged at the housing of the respective transmission 22 to 25 projects between the two respective associated connection plates 27 and a pin projects into openings in the connection plates 27 and in the plate arranged at the transmission housing. The torque which is transmitted via the transmissions 22 to 25 to the associated cable drums 10 to 13 is transmitted to the frame via this connection of the transmission housing to the frame. The pins 28 are loaded by this torque. A load measuring device for detecting the torque applied by the driving motors 20, 21 can be constructed by integrating strain gauges or elongation measurement strips in the pins 28.

The points of application of the hoisting cables 1 to 8 of a respective cable pair at the load suspension apparatus 9 lie in the area of the center of one side of an imaginary rectangle; the points of application of the longitudinal cable pairs are located in the centers of the longer sides, and the points of application of the transverse cable pairs are located in the centers of the shorter sides.

The points of application of the cable pairs could also be located in the central areas of a respective side of an imaginary square. In that case, any of the cable pairs located across from one another could be designated as the longitudinal cable pairs or as the transverse cable pairs.

The imaginary rectangle or square lies in a substantially horizontal plane. By substantially horizontal is meant in this connection that the deviation horn the horizontal is preferably less than 1°.

Separate brakes 29, 30 are preferably provided for the two hoists 18, 19. Only the brake disks arranged on one of the driveshafts 31 of the respective driving motors 20, 21 are shown schematically in the drawings. These brake disks cooperate with brake shoes which are not shown in the drawings.

In the present embodiment example, all of the cable pairs engage at a connection member 32 for connecting to the load suspension apparatus 9, this connection member 32 being mounted so as to be displaceable along the load suspension apparatus 9, namely, in those planes 14 to 17 in which the free cable lengths of the hoisting cables 1 to 8 of this cable pair lie. This displacement is preferably oriented in a substantially horizontal direction. By substantially horizontal is meant in this connection that the deviation from the horizontal is preferably less than 1°

Guide rails 33, along which the connection members 32 are supported so as to be displaceable, are arranged, for example, at the load suspension apparatus 9 as is shown for the displaceable bearing support of the connection members 32.

The displaceability of the connection members 32 relative to the load suspension apparatus 9 can be blocked, namely, preferably at adjustable positions. For this purpose, in the present embodiment example, a piston-cylinder unit 34 acts at the respective connection member 32. For example, the cylinder of the piston-cylinder unit 34 can be arranged at the guide rail 33, and the piston of the piston-cylinder unit 34 can be arranged at the associated connection member 32. By means of the piston-cylinder unit, the respective connection member 32 can be displaced along the guide rail 33 and secured at a desired position (in that the cylinder chambers are closed on both sides of the piston acting at both sides). Further, the displacement of the connection member 32 relative to the associated guide rail 33 can be released (by short circuiting the two cylinder chambers).

In the present embodiment example, the load suspension apparatus 9 comprises a head unit 35 (commonly known as a head block at which the connection members 32 are mounted so as to be displaceable) and a carrying unit 36 which is detachably connected to the latter. For example, the carrying unit 36 can be constructed for carrying containers and is then usually called a spreader. Load suspension apparatus of this kind are known and need not be described in detail in the present connection.

Figure 2:
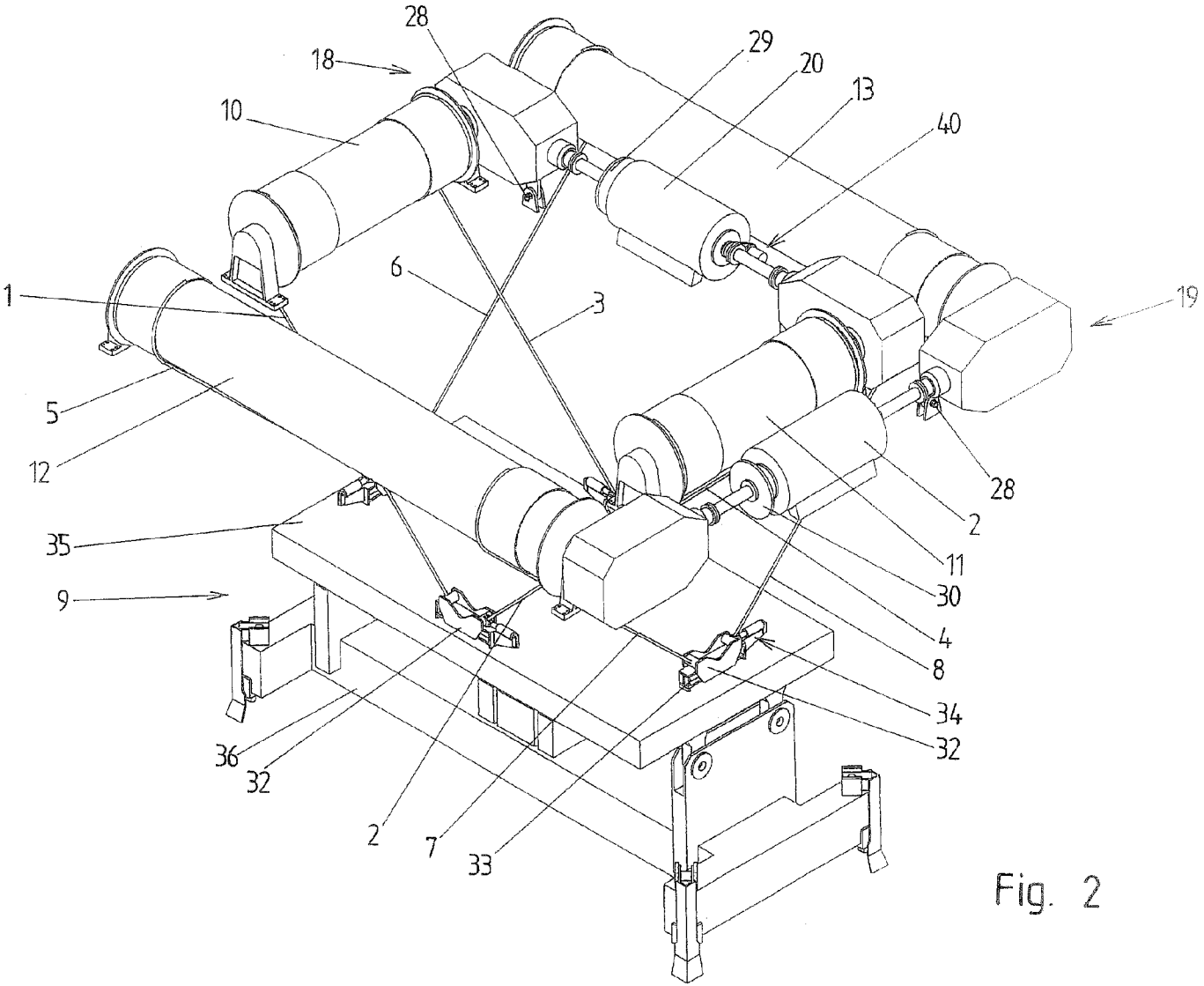
Figure 3:
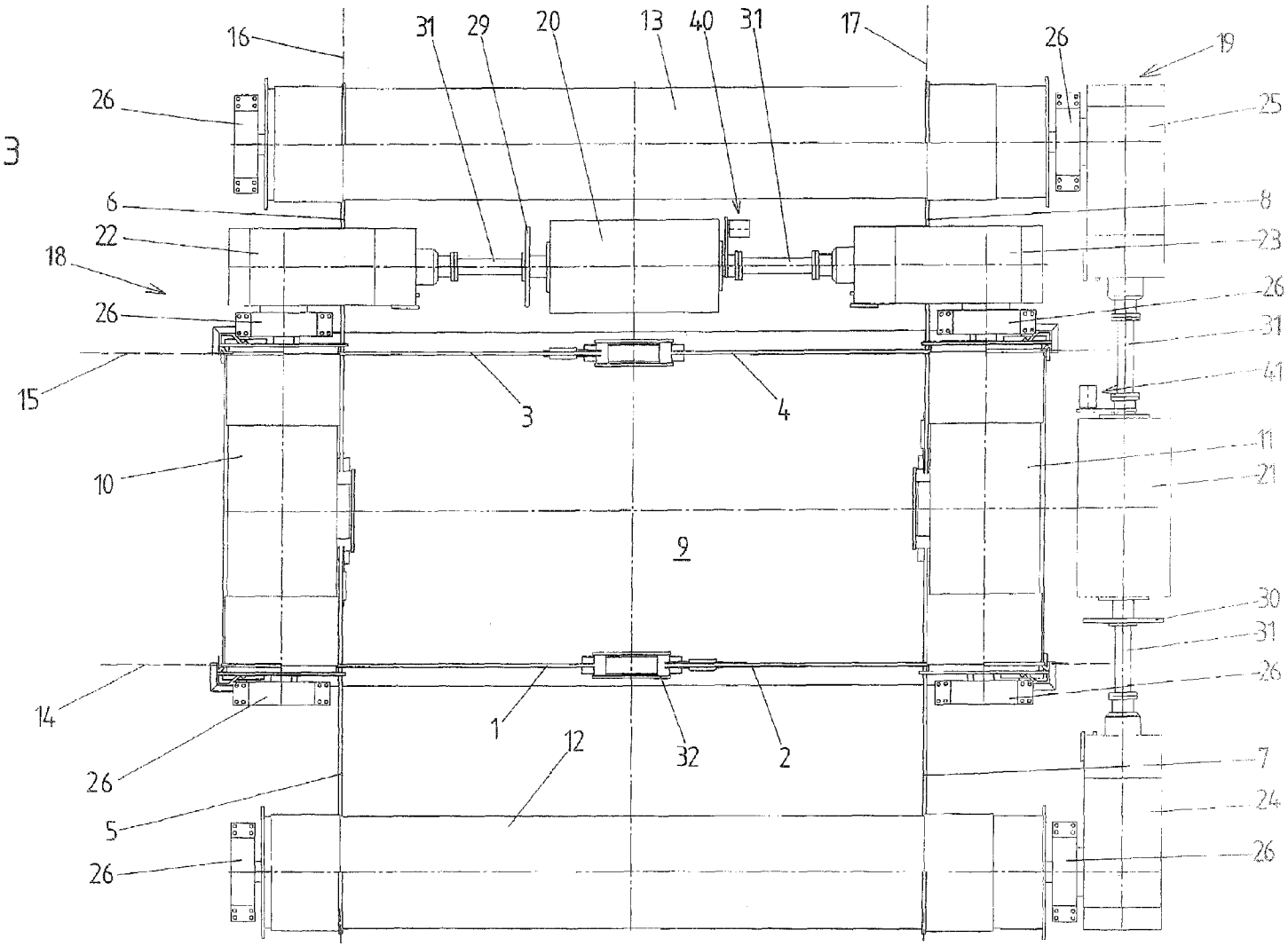
FIG. 3 shows a top view.
Figure 4:
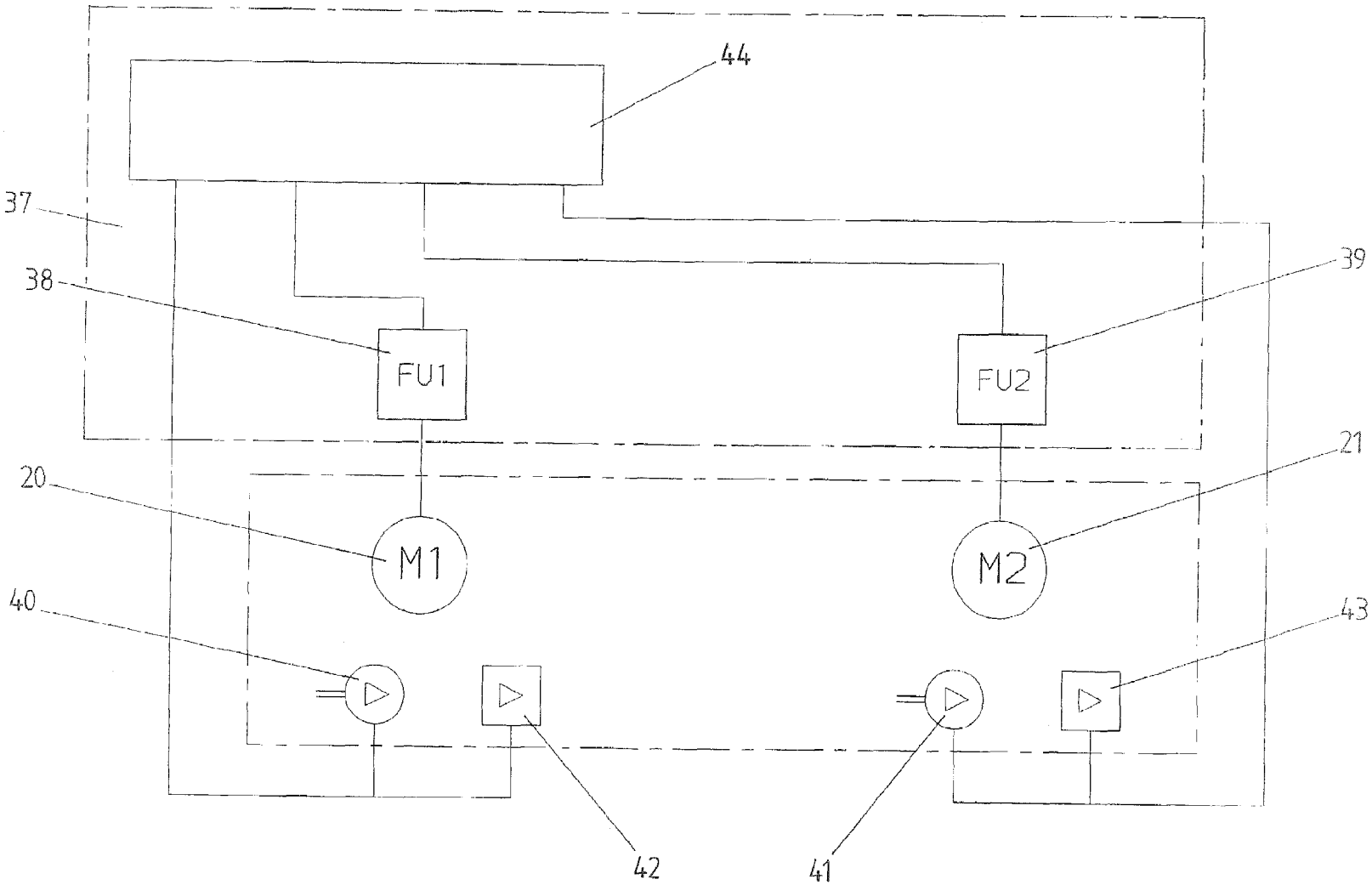
FIG. 4 is a schematic diagram of the electronic control of the driving motors.

The electronic control of the lifting device will be described in the following with reference to the schematic in FIG. 4. The two driving motors 20 21 are controlled by a common control device 37. In the present embodiment example, this control device 37 comprises a central unit 44, which is constructed, for example, in the form of an SPS, and the two frequency converters 38, 39 which are associated with a respective driving motor 20, 21 and by which the speed of a respective driving motor 20, 21 is adjusted. Rotary encoders 40, 41 which record the actual speed of the respective driving motor 20, 21 are connected to the driving motors 20, 21. These rotary encoders 40, 41 are also shown schematically in FIGS. 2 and 3 and are shown in these drawings as tachometers connected to the driveshaft 31 of the respective driving motor 20, 21 via belts. The measured values detected by the rotary encoders 40, 41 are supplied to the control device 37 and, in the latter preferably next to the central unit 44, also to the respective frequency converter 38, 39. Based on these actual values and desired reference values, the speed of the driving motors 20, 21 is regulated by the control device 37. A torque regulation of the driving motors 20, 21 is superimposed on this speed regulation. For this purpose, load measuring devices 42, 43 are provided which detect the torque applied by the respective driving motor 20, 21. The load measuring devices 42, 43 can be constructed, for example, in the described manner by means of elongation measurement strips arranged at the pin 28. The measured values detected by the load measuring devices 42, 43 are supplied to the control device 37. When the torques of the two driving motors 20, 21 deviate from one another, i.e., the longitudinal cable pairs and transverse cable pairs have different tension, the speed of the driving motors 20, 21 for which the greater torque has been determined is correspondingly reduced relative to the speed of the other driving motor 20, 21 until the torque deviation is corrected, or the speed of the driving motor 20, 21 for which the smaller torque has been determined is correspondingly increased relative to the speed of the other driving motor 20, 21 until the torque deviation is corrected.

The displacement of one of the connection members 32 relative to the load suspension apparatus 9 can advantageously be enabled during the lifting and lowering of the load while the other connection members 32 are held so as secured against displacement. This counteracts jamming between the individual hoisting cables 1 to 8 which could otherwise result in the formation of opposing torques. Accordingly, the cable tensions can be kept as low as possible. When the load suspension apparatus 9 is constructed in a rectangular shape as is shown in the drawings, the displaceability of one of the two connection members 32 arranged at the longer sides is preferably enabled. This provides for a greater stability than if one of the two connection members 32 arranged at the narrow sides were released—because the larger torques act on the connection members 32 which are farther from the center with respect to the lever ratios—and, for example, also when loaded by wind, whose effect is greater on the longitudinal sides of the containers.

When the load suspension apparatus 9 has reached the predetermined height at least approximately, the previously released connection member 32 is secured again. Consequently, through the displacement of the connection members 32 by means of the piston-cylinder units 34, a precise positioning of the load can be carried out as is already known.

In a simplified embodiment form of the invention, three of the cable pairs can also be fixedly connected to the load suspension apparatus, and the fourth cable pair can be connected to the load suspension apparatus by means of a displaceable connection member, preferably one of the two longitudinal cable pairs. A blocking device could also be provided for blocking the displacement in order to increase the stability of the load suspension apparatus 9 when the predetermined height has been reached.

Various other modifications of the embodiment example of the invention shown herein are conceivable and possible without departing from the field of the invention.

In the device according to the invention, all of the hoisting cables 1 to 8 are loaded substantially identically so that there is uniform wear of the cables until the replacement stage is reached. The hoisting cables 1 to 8 need only be adjusted geometrically; the cable forces are determined by the regulated hoists 18, 19. At most, a readjustment of the cables may be required with respect to the geometry of the position of the load suspension apparatus 9. Tolerances in the cable diameter, cable drums and in the placement of the hoists, as well as different stretching behavior of the hoisting cables, deformations of the carrying frame and of other structural component parts do not affect the cable forces.

Therefore, there are no particularly demanding requirements with respect to the precision of the structural component parts and placement of the hoists in the device according to the invention. The hoisting cables 1 to 8 need not necessarily be from the same batch, because differences in stretching behavior and in diameter do not affect the occurring cable forces. The longest possible life of the cables can be achieved because of the uniform loading and because unnecessary cable deflection is preferably dispensed with. Maintenance costs are low due to the omission of costly adjustment work on the cables and the substantially longer cable replacement intervals. The availability of the lifting device is increased.

In emergencies (e.g., outage of a drivetrain), the entire load can be carried by one of the two hoists 18, 19 and securely braked by the brakes 29, 30 of this hoist 18, 19.

As follows from the preceding description, the field of the invention is not limited to the embodiment examples shown herein, but rather should be defined with reference to the appended claims together with their full range of possible equivalents.

While the preceding description and drawings show the invention, it is obvious to the person skilled in the art that various modifications can be carried out without departing from the spirit of and field of the invention.

REFERENCE NUMBERS

1 hoisting cable
2 hoisting cable
3 hoisting cable
4 hoisting cable
5 hoisting cable
6 hoisting cable
7 hoisting cable
8 hoisting cable
9 load suspension apparatus
10 cable drum
11 cable drum
12 cable drum
13 cable drum
14 longitudinal plane
15 longitudinal plane
16 transverse plane
17 transverse plane
18 hoist
19 hoist
20 driving motor
21 driving motor
22 transmission
23 transmission
24 transmission
25 transmission
26 bearing
27 connection plate
28 pin
29 brake
30 brake
31 driveshaft
32 connection member
33 guide rail
34 piston-cylinder unit
35 head unit
36 carrying unit
37 control device
38 frequency converter
39 frequency converter
40 rotary encoder
41 rotary encoder
42 load measuring device
43 load measuring device
44 central unit

What is claimed is:

1. A lifting device comprising:

two longitudinal cable pairs with hoisting cables which are arranged in a V-shape relative to one another and which engage at a load suspension apparatus and which are taken off from drivable cable drums for lifting and lowering the load suspension apparatus and which have free lengths of cable lying in longitudinal planes which are located at a distance from one another;

two transverse cable pairs with hoisting cables which are arranged in a V-shape relative to one another and which engage at the load suspension apparatus and which are taken off from drivable cable drums for lifting and lowering the load suspension apparatus and which have free lengths of cable lying in transverse planes which are located at a distance from one another and extend at right angles to the longitudinal planes; and two mechanically separate hoists being provided for the hoisting cables of the two longitudinal cable pairs and for the hoisting cables of the two transverse cable pairs, each of the hoists being drivable by its own driving motor, and wherein the driving motors are controlled by a common control device.

2. The lifting device according to claim 1, wherein each of the two hoists has separate cable drums for the two hoisting cables of a cable pair associated with the respective hoist.

3. The lifting device according to claim 2, wherein the separate cable drums of a respective hoist are mechanically coupled and run synchronously.

4. The lifting device according to claim 1, wherein the longitudinal axes of the cable drums of the hoist for the hoisting cables of the longitudinal cable pairs extend at right angles to the longitudinal planes in which the hoisting cables of the longitudinal cable pairs lie, and the longitudinal axes of the cable drums of the hoist for the hoisting cables of the transverse cable pairs extend at right angles to the transverse planes in which the hoisting cables of the transverse cable pairs lie.

5. The lifting device according to claim 1, wherein rotary encoders are provided for detecting the speed of the driving motors, and the values measured by the rotary encoders are supplied to the common control device for regulating the speed of the driving motors.

6. The lifting device according to claim 1, wherein load measuring devices are provided for detecting the torque applied by the driving motors, and the values measured by the load measuring devices are supplied to the control device.

7. The lifting device according to claim 1, wherein the speed of the driving motors is regulated by means of the common control device, and a torque regulation of the driving motors is superimposed on this speed regulation.

8. The lifting device according to claim 1, wherein a separate brake is provided for each of the two hoists.

9. The lifting device according to claim 1, wherein the longitudinal planes in which the free lengths of the hoisting cables of the longitudinal cable pairs lie and the transverse planes in which the free lengths of the hoisting cables of the transverse cable pairs lie are oriented substantially vertically.

10. The lifting device according to claim 1, wherein the two hoisting cables of at least one cable pair engage at a connection member for connecting to the load suspension apparatus, said connection member being mounted at the load suspension apparatus so as to be displaceable relative to it in the planes in which the free cable lengths of the hoisting cables of this cable pair lie.

11. The lifting device according to claim 10, wherein the connection member is mounted so as to be displaceable in a substantially horizontal direction.

12. The lifting device according to claim 10, wherein the displacement of the at least one displaceable connection member can be blocked.

* * * * *